US006880206B2

(12) United States Patent
Pferdmenges et al.

(10) Patent No.: US 6,880,206 B2
(45) Date of Patent: Apr. 19, 2005

(54) MULTI-ELEMENT SEPARATION MODULES FOR A FIBER PROCESSING MACHINE

(75) Inventors: Gerd Pferdmenges, Jüchen (DE); Robert Pischel, Mönchengladbach (DE)

(73) Assignee: Trützschler GmbH & Co. KG, Mönchengladbach (DE)

( * ) Notice: Subject to any disclaimer, the term of this patent is extended or adjusted under 35 U.S.C. 154(b) by 5 days.

(21) Appl. No.: 10/366,575

(22) Filed: Feb. 14, 2003

(65) Prior Publication Data

US 2003/0154572 A1 Aug. 21, 2003

(30) Foreign Application Priority Data

Feb. 20, 2002 (DE) ..... 102 07 159

(51) Int. Cl.[7] ..... D01B 3/00
(52) U.S. Cl. ..... 19/200; 19/204; 19/205
(58) Field of Search ..... 19/98, 104, 105, 19/107, 108, 109, 110, 113, 200, 203, 204, 205

(56) References Cited

U.S. PATENT DOCUMENTS

| | | | | | |
|---|---|---|---|---|---|
| 3,858,276 | A | * | 1/1975 | Hollingsworth | 19/98 |
| 4,797,980 | A | * | 1/1989 | Jagst | 19/107 |
| 4,805,267 | A | * | 2/1989 | Leifeld | 19/105 |
| 5,022,121 | A | * | 6/1991 | Rutz | 19/102 |
| 5,031,278 | A | * | 7/1991 | Demuth et al. | 19/98 |
| 5,095,584 | A | * | 3/1992 | Temburg | 19/107 |
| 5,107,571 | A | | 4/1992 | Marzoli et al. | |
| 5,448,800 | A | | 9/1995 | Faas et al. | |
| 5,737,806 | A | * | 4/1998 | Leifeld et al. | 19/98 |
| 6,145,166 | A | | 11/2000 | Waeber et al. | |
| 6,640,391 | B1 | * | 11/2003 | Breuer et al. | 19/98 |
| 6,668,425 | B1 | * | 12/2003 | Breuer et al. | 19/98 |

FOREIGN PATENT DOCUMENTS

| | | |
|---|---|---|
| DE | 33 36 323 A1 | 5/1985 |
| DE | 36 44 529 A1 | 7/1988 |
| DE | 38 35 776 A1 | 4/1990 |
| DE | 41 25 035 A1 | 2/1993 |
| DE | 94 19 619.2 U1 | 3/1995 |
| EP | 0 366 918 A1 | 5/1990 |
| EP | 0 387 908 A1 | 9/1990 |
| EP | 0 848 091 A1 | 6/1998 |
| GB | 1 058 894 | 2/1967 |
| GB | 1 512 468 | 6/1978 |
| GB | 2 200 376 A | 8/1988 |
| GB | 2 228 495 A | 8/1990 |
| GB | 2 247 253 A | 2/1992 |
| GB | 2 378 453 A | 2/2003 |

* cited by examiner

*Primary Examiner*—Gary L. Welch
(74) *Attorney, Agent, or Firm*—Venable LLP; Robert Kinberg

(57) ABSTRACT

A device is provided for separating out foreign particles and/or neps in a pre-carding zone and/or a post-carding zone of a carding machine having a carding cylinder. The device has at least two modules arranged opposite the carding cylinder in the pre-carding zone and/or the post-carding zone. Each module has a plurality of operating elements, the elements being arranged beside one another as seen in a circumferential direction of the cylinder. The operating elements are fixed carding elements, suctioning devices, and/or separating knives.

15 Claims, 5 Drawing Sheets

MULTI-ELEMENT SEPARATION MODULES FOR A FIBER PROCESSING MACHINE

CROSS-REFERENCE TO RELATED APPLICATION

This application claims priority to German Patent Application No. 102 07 159.4, filed Feb. 20, 2002, the disclosure of which is incorporated herein by reference.

BACKGROUND OF THE INVENTION

The invention relates to a device on a carding machine having a plurality of operating elements, for example fixed carding elements, suctioning devices, separating knifes and the like, arranged opposite a cylinder, for example the main carding cylinder, in the pre-carding and post-carding zone. The operating elements are arranged side-by-side, as seen in a circumferential direction of the cylinder, wherein at least two of the operating elements form a module.

In a known device, as shown in German patent document 38 35 776 A1, modules comprise two or more operating elements and are mounted on an end plate of the carding machine. A cleaning device in the form of a suctioning unit is provided, to which a guide bar is assigned in front and a knife bar in back. The disadvantage of this arrangement is that it does not allow control over the composition of the separated out foreign particles (waste composition) and does not permit the removal of neps.

SUMMARY OF THE INVENTION

It is an object of the invention to create a device of the above-described type, which avoids the aforementioned disadvantages and, in particular, makes it possible to change and/or influence the waste composition, as well as the removal of neps.

This and other objects are achieved by a device for separating out foreign particles and/or neps in a pre-carding zone and/or a post-carding zone of a carding machine having a carding cylinder. The device has at least two modules arranged opposite the carding cylinder in the pre-carding zone and/or the post-carding zone. Each module has a plurality of operating elements, the elements being arranged beside one another as seen in a circumferential direction of the cylinder. The operating elements are fixed carding elements, suctioning devices, and/or separating knives.

The separating out of interfering foreign particles and/or neps can be improved considerably as a result of measures according to the invention. One particular advantage of the invention is that a multifunctional arrangement of the operating elements is possible. This permits a flexible adaptation to the fiber material to meet high quality requirements for the product to be produced. In addition, the modular design, and the uniform angular extension in particular, makes it possible to considerably reduce the time required for replacing worn operating elements while maintaining a high assembly precision of the exchanged elements.

BRIEF DESCRIPTION OF THE DRAWINGS

The invention is explained below in further detail with the aid of exemplary embodiments shown in the drawings, wherein.

DETAILED DESCRIPTION OF THE INVENTION

Figure 1:
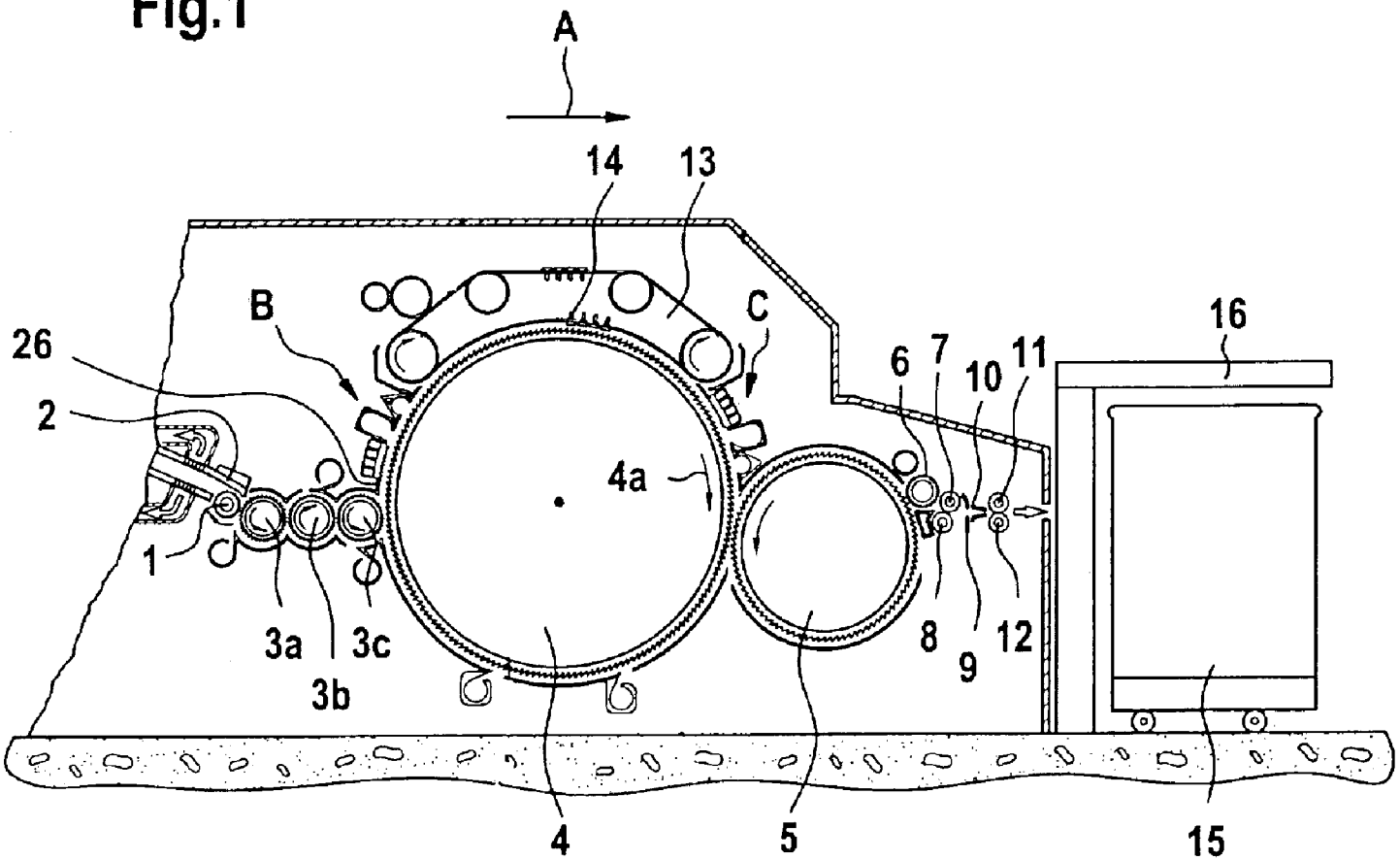
FIG. 1 is a schematic side elevation view of a carding machine with the device according to the invention.

FIG. 1 shows a carding machine, for example a high-performance card DK 903 by the company Trützschler in M önchengladbach, Germany. The carding machine has a feed roll 1, a feed table 2, licker-ins 3*a*, 3*b*, 3*c*, a main carding cylinder 4, a doffer 5, a stripping roll 6, crushing rolls 7, 8, a sliver-guide element 9, a web trump 10, withdrawing rolls 11, 12, traveling flats 13 with flat bars 14, a can 15 and a sliver-coiler arrangement 16. Curved arrows indicate the rotational direction of the rolls, while arrow A indicates the operating direction. A device according to the invention can be arranged, for example, at the locations B and/or C on the main carding cylinder 4.

Figure 2:
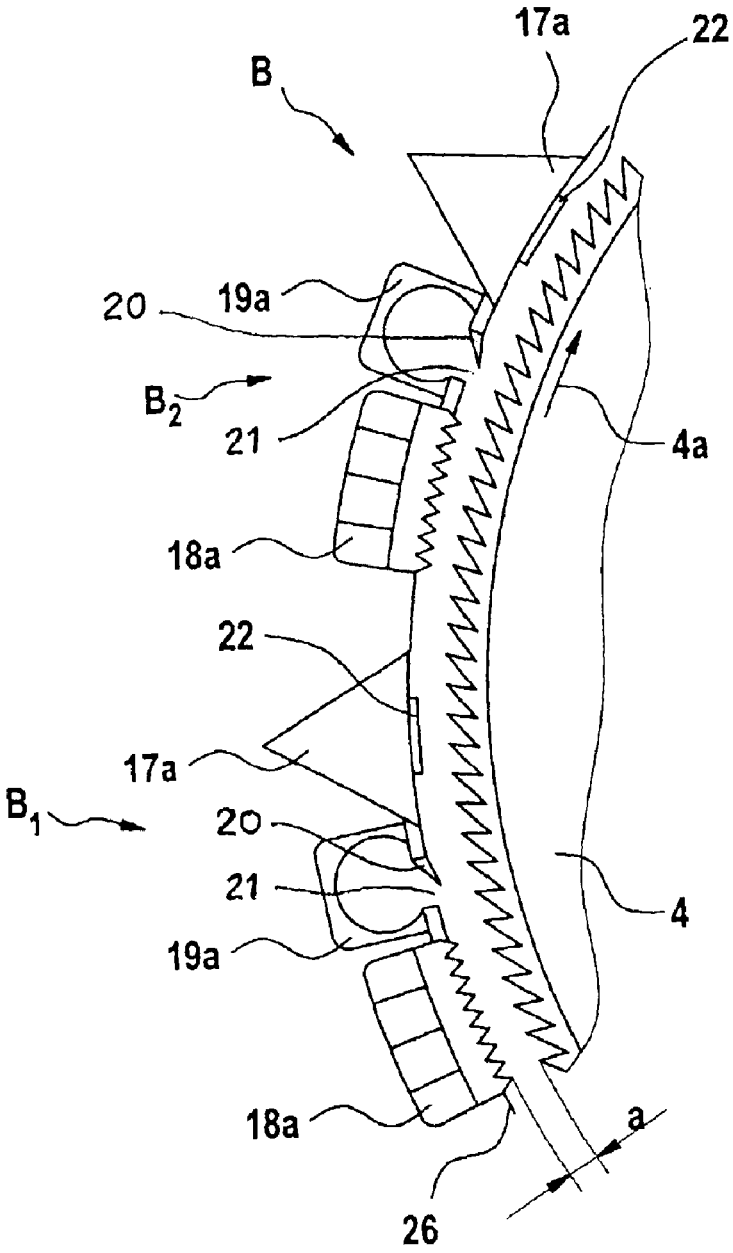
FIG. 2 shows an embodiment of the device with two modules for separating out foreign particles in the pre-carding zone.

As shown in FIG. 2, two modules $B_1$, $B_2$ are mounted one behind the other at the location B, as seen in rotational direction 4*a* of the main carding cylinder 4. The modules are respectively provided with a fixed carding element 18*a*, a suction hood 19*a* with separating knife 20 and separating opening 21 and a pressure element 17*a* with pressure rod 22. As a result of the modules $B_1$, $B_2$ that are mounted one behind the other, a considerable improvement in the separating out of foreign particles such as trash, seed parts, leaf rests and the like is possible.

Figure 3:
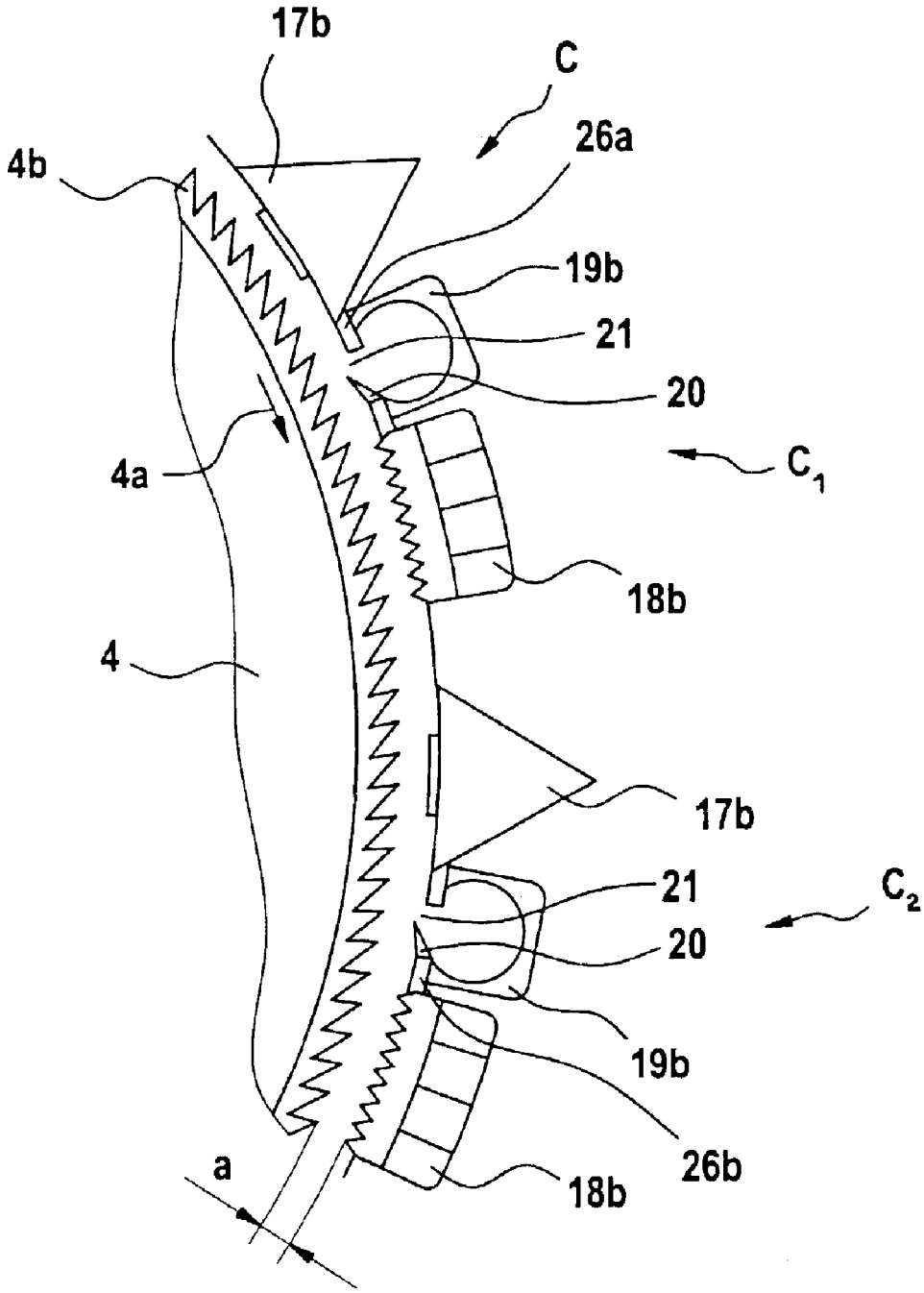
FIG. 3 shows an embodiment of the device with two modules for separating out neps in the post-carding zone.

As shown in FIG. 3 and seen in rotational direction 4*a* of the main carding cylinder 4, two modules $C_1$, $C_2$ are mounted one behind the other at location C. These modules are respectively provided with a pressure element 17*b* with pressure rod 22, a suctioning hood 19*b* with separating knife 20 and separating opening 21, as well as a fixed carding element 18*b*. The separating out of the neps is improved considerably as a result of arranging the modules $C_1$, $C_2$ one behind the other. The main carding cylinder has clothing 4*b*, and covers 26, 26*a*, 26*b* are positioned opposite the clothing 4*b*.

Figure 4:
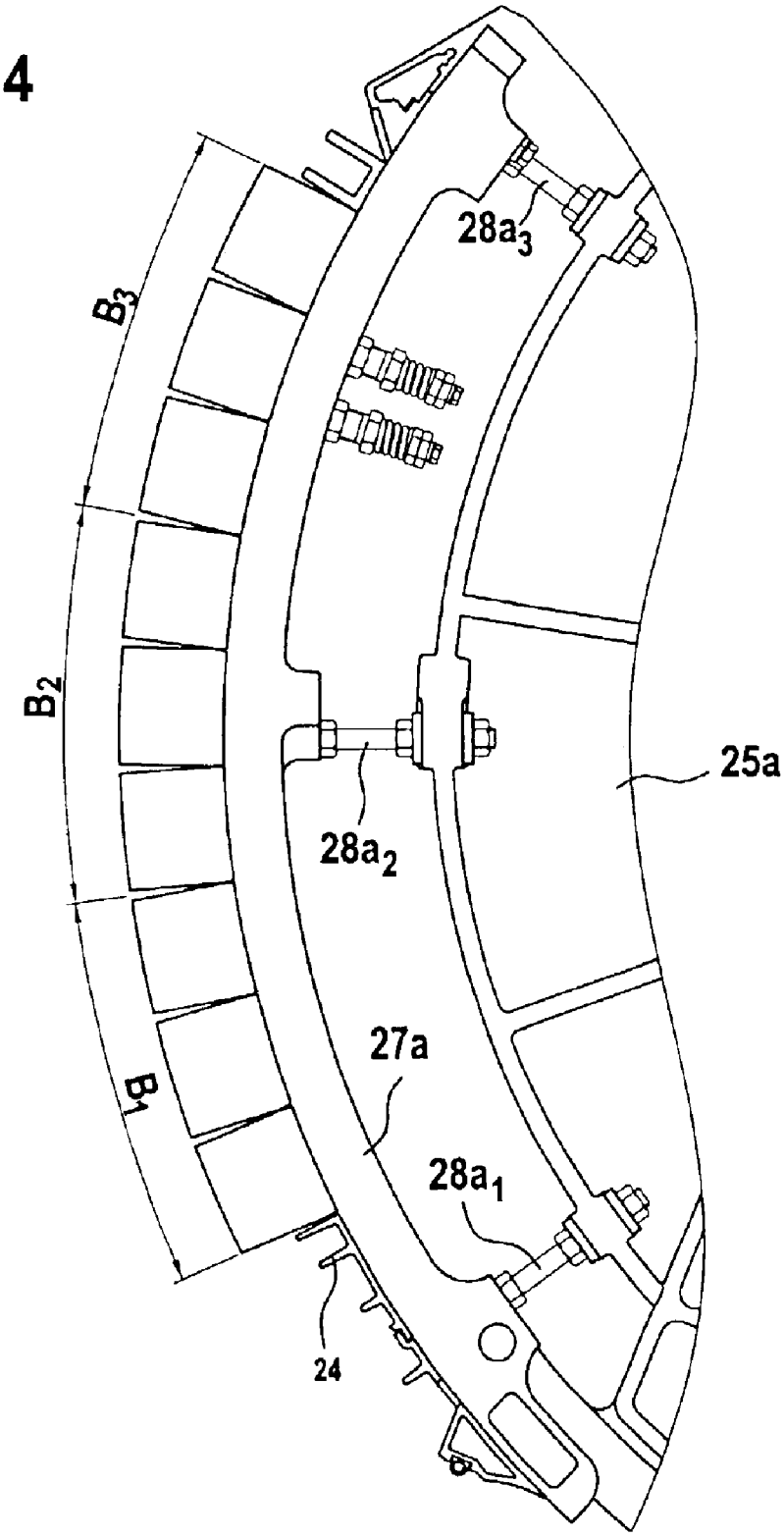
FIG. 4 shows an embodiment of the device with three modules for separating out foreign particles and neps in the pre-carding zone.
Figure 5:
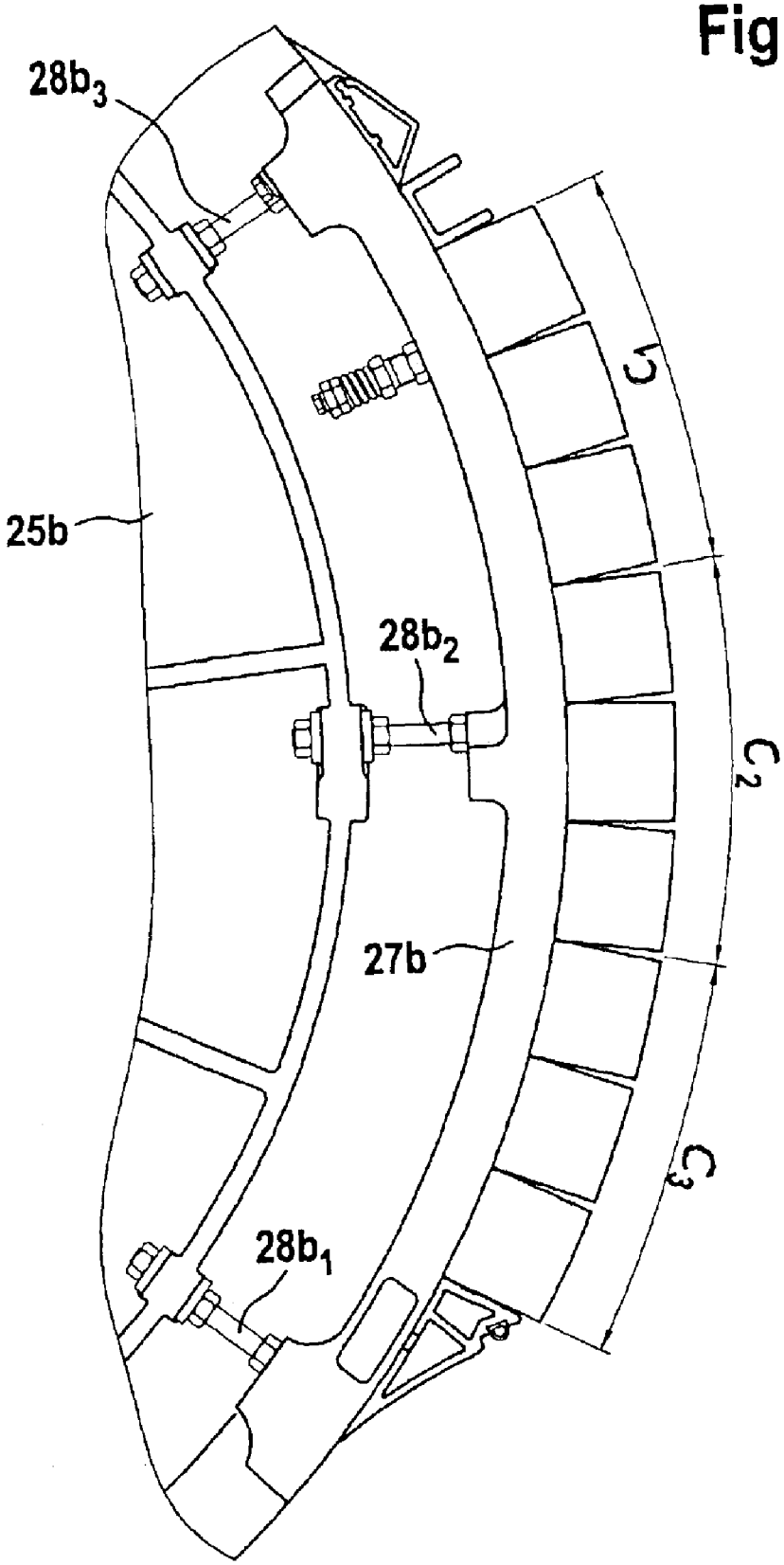
FIG. 5 shows an embodiment of the device with three modules for separating out foreign particles and neps in the post-carding zone.

FIGS. 4 and 5 show, respectively, three modules provided in the pre-carding zone B and the in the post-carding zone C. Respectively two modules $B_1$, $B_3$; $C_1$, $C_3$ serve for separating out foreign particles and one module $B_2$; $C_2$ is used for separating out the neps. A neutral cover element 24 is provided outside of the carding zones B,C. The modules $B_1$, $B_2$, $B_3$; $C_1$, $C_2$, $C_3$ are arranged on the extension bends 27*a*, 27*b* of the carding machine. The extension bends 27*a* and 27*b* are attached on each side of the carding machine to a card end plate 25*a* and/or 25*b*. The extension bends 27*a* and 27*b* can be adjusted via at least three adjustment spindles $\mathbf{28}a_1$, $\mathbf{28}a_2$, $\mathbf{28}a_3$ and/or $\mathbf{28}b_1$, $\mathbf{28}b_2$, $\mathbf{28}b_3$. The distance a (FIGS. 2, 3) between operating elements and/or modules and the clothing for the main carding cylinder 4 can be adjusted in this way.

The invention has been described in detail with respect to preferred embodiments and it will now be apparent from the foregoing to those skilled in the art that changes and modifications may be made without departing from the invention in its broader aspects. The invention, therefore, is intended to cover all such changes and modifications that fall within the true spirit of the invention.

What is claimed is:

1. A device for separating out at least one of foreign particles and neps in at least one of a pre-carding zone and a post-carding zone of a carding machine having a carding cylinder, the device comprising:

at least two modules arranged opposite the carding cylinder in each of at least one of the pre-carding zone and the post-carding zone, each module having a plurality of operating elements, the elements being arranged beside one another as seen in a circumferential direction of the cylinder wherein the operating elements comprise, at least one fixed carding element, one separating element and one pressure element, as seen in the rotational direction of the carding cylinder.

2. The device according to claim 1, wherein the separating element has a suctioning hood.

3. The device according to claim 1, wherein the separating element is provided with a separating knife.

4. The device according to claim 1, wherein the pressure element is adjustable for changing a pressure between a cover of the carding machine and the carding cylinder.

5. The device according to claim 4, wherein the pressure element comprises a pressure rod.

6. The device according to claim 1, wherein at least one of the modules is for separating out foreign particles and another of the modules is for separating out neps.

7. The device according to claim 6, wherein the module for separating out foreign particles is installed in front of the nep separating module as seen in the rotational direction of the carding cylinder.

8. The device according to claim 6, wherein in one of the pre-carding zone and the post-carding zone, at least one module for separating out foreign particles is installed behind one nep separating module, as seen in the rotational direction of the carding cylinder.

9. The device according to claim 1, wherein the pre-carding zone and the post-carding zone are divided into a plurality of angular regions, as referred to a rotational axis of the main carding cylinder, which all have a uniform angular extension or an integral multiple of this uniform angular extension.

10. The device according to claim 9, wherein the modules comprise the same angular region.

11. The device according to claim 9, wherein a neutral cover element is arranged in at least one angular region.

12. A device for separating out at least one of foreign particles and neps in at least one of a pre-carding zone and a post-carding zone of a carding machine having a carding cylinder, the device comprising:

at least two modules arranged opposite the carding cylinder in each of at least one of the pre-carding zone and the post-carding zone, each module having a plurality of operating elements, the elements being arranged beside one another as seen in a circumferential direction of the cylinder, wherein the operating elements comprise at least one of a fixed carding element, a suctioning device, and a separating element, wherein at least three modules are provided in one of the pre-carding zone and the post-carding zone.

13. A device for separating out at least one of foreign particles and neps in at least one of a pre-carding zone and a post-carding zone of a carding machine having a carding cylinder, the device comprising:

at least two modules arranged opposite the carding cylinder in each of at least one of the pre-carding zone and the post-carding zone, each module having a plurality of operating elements, the elements being arranged beside one another as seen in a circumferential direction of the cylinder, wherein the operating elements comprise at least one of a fixed carding element, a suctioning device, and a separating knife, wherein the modules are arranged on an extension bend of the carding machine.

14. The device according to claim 13, wherein the extension bend is attached on each side of the carding cylinder to a card end plate.

15. The device according to claim 13, wherein the extension bend is adjustable via at least three adjustment elements.

* * * * *